US006795563B2

(12) United States Patent
Ohta

(10) Patent No.: US 6,795,563 B2
(45) **Date of Patent: *Sep. 21, 2004**

(54) SPEAKER FOR AN ELECTRONIC INSTRUMENT

(75) Inventor: Yoshizumi Ohta, Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 28 days.

This patent is subject to a terminal disclaimer.

(21) Appl. No.: 09/837,366

(22) Filed: Apr. 19, 2001

(65) Prior Publication Data

US 2001/0033672 A1 Oct. 25, 2001

(30) Foreign Application Priority Data

Apr. 24, 2000 (JP) ..... 2000-123036

(51) Int. Cl.[7] ..... H04R 25/00

(52) U.S. Cl. ..... 381/409; 381/396; 381/410; 381/395; 381/412; 340/388.1

(58) Field of Search ..... 381/409, 150, 381/410, 386, 394, 395, 396, 400, 420, 412, 431, 154, 159, 182, 152, 175; 439/492, 86; 340/388.1, 391.1, 384.1, 407.1, 825.44, 825.4

(56) References Cited

U.S. PATENT DOCUMENTS 3,774,200 A * 11/1973 Heath
3,950,744 A * 4/1976 Stephens
5,066,235 A * 11/1991 Kobayashi
5,287,084 A * 2/1994 Sone
6,023,518 A * 4/1999 Kuwabara
6,526,152 B2 * 1/2001 Frasl
6,476,710 B2 * 11/2002 Togawa

* cited by examiner

*Primary Examiner*—Huyen Le
*Assistant Examiner*—Dionne Harvey
(74) *Attorney, Agent, or Firm*—Dennison, Schultz, Dougherty & MacDonald

(57) ABSTRACT

A speaker has a frame provided with a yoke, a magnet, a vibrating plate and a voice coil, and a pair of leads. An end of each of the leads is connected to an end of the coil and the other end portion of the lead is exposed in a hole formed in the frame and secured to the frame so as to be connected to an outside terminal. A terminal connecting device is provided for connecting the other end of the lead to the outside terminal. The terminal connecting device comprises a cylindrical case secured in the hole of the frame, a connecting rod slidably mounted in the cylindrical case, and a coil spring provided in the cylindrical case to outwardly urge the connecting rod so as to be contacted with the outside terminal at an end of the rod. A top end of the cylindrical case is contacted with the end portion of the lead.

4 Claims, 9 Drawing Sheets

SPEAKER FOR AN ELECTRONIC INSTRUMENT

BACKGROUND OF THE INVENTION

The present invention relates to a speaker for generating sounds by vibrating a vibration plate by an electromagnet, and more particularly to an electrodynamic speaker mounted on a printed circuit board of an electronic instrument such as a portable telephone.

In recent years, there is a tendency to mount small electric parts on a printed circuit board, electrodynamic speaker for the small electronic instrument is accordingly mounted on the printed circuit board. Such a printed circuit for the portable telephone is used as a signaling device.

Referring to FIGS. 5 and 6, which are a plan view of a conventional electrodynamic speaker and a sectional view taken along a line VI—VI of FIG. 5 respectively, electrodynamic speaker 50 has a circular frame 51 having a central circular hole 51*b* and a cubic portion 51*a*. An annular shoulder 51*c* is formed on the frame 51 and a pair of cylindrical holes 51*d* are formed in the cubic portion 51*a*. A plurality of perforations 51*e* are formed in the frame 51.

A yoke 52 made of magnetic material and having a dish-shape is secured to the wall of the central hole 51*b*. A disk-shape magnet 53 is secured on the yoke 52 and a disk-shape top plate 54 is securely mounted on the magnet 53. Thus, a magnetic circuit is formed between the yoke 52 and the top plate 54, interposing the magnet 53.

An annular vibrating plate 55 made of plastic has a spherical central portion, a circular recess 55*a* at the periphery of the central portion and a peripheral portion 55*b*. An annular voice coil 56 is fixed to the underside of the recess 55*b* and inserted in the gap between the periphery of the top plate 54 and an upper portion of the yoke 52.

A pair of lead plates 57, each of which is made of an elongated metal plate, are embedded in the frame 51. Each of the lead plates 57 is extended between a side wall of the cubic portion 51*a* and an end 57*a* exposed in the underside of the frame 51. A coil spring 58 is inserted in each hole 51*d*. An upper end 58*a* (FIG. 7*a*) of the coil spring 58 is inserted in a hole 57*c* formed in an end portion 57*b* of the lead plate 57 and electrically connected to the lead plate 57 by solder 65 (FIG. 7*b*). The lower end of the spring 58 is projected from the underside of the frame 51.

Both ends of the coil 56 are soldered to ends 57*a* of lead plates 57. Thus, the coil 56 is connected to the coil springs 58.

A cover 59 has sound emanating holes 59*a* and is adhered to the shoulder 51*c*.

Here, it is necessary to accurately assemble the coil spring 58 in the hole 51*d* so as not to contact with the inner wall of the hole 51*d*. FIGS. 7*a* and 7*b* are sectional views showing a method for assembling the coil spring. A positioning jig 90 is provided for positioning the frame 51. The positioning jig 90 has a pair of positioning holes, each comprising a spring positioning hole 90*a*.

In the assembling of the coil spring 58, the frame 51 is mounted on the jig 90 as shown in FIG. 7*a*. The coil spring 58 is inserted in the spring positioning hole 90*a* of the jig 90 and the hole 51*d* of the frame 51. The upper end 58*a* of the coil spring 58 is inserted in the hole 57*c* of the end portion 57*b* of the lead plate 57 and the coil spring is compressed by a pressing jig 91. The upper end 58*a* of the coil spring 58 is connected to the end portion 57*b* by the solder 65 as shown in FIG. 7*b*.

Referring to FIG. 8, the frame 50 is mounted on a printed circuit board 81. The end of the coil spring 58 is pressed against a terminal on the circuit board 81 so that the electric current is applied to the coil 56 to vibrate the vibrating plate 55. The generated sound is emanated from the sound emanating hole 59*a*.

FIG. 9 is a sectional view showing a connecting portion of another conventional buzzer. A U-shaped connecting spring plate 62 is connected to a lead plate 61 secured to a case 60 of the speaker by solder 63 at an end thereof. Another end of the spring plate 62 is pressed against a terminal of a printed circuit board 82.

When the case 60 is mounted on the circuit board 82, the connecting spring plate 62 is bent and the end of the plate is contacted with a terminal of the circuit board 82.

Therefore, if there is formed a gap between the case 60 and the circuit board 82, the contact of the spring plate 62 with the terminal is kept.

FIG. 10 is a sectional view showing a further conventional connecting terminal device. A lead plate 71 is embedded in a speaker body 70. A cord 72 is fixed to the lead plate 71 by solder 74. A plug 73 is connected to the cord 72 and connected to a socket 75 on the circuit board 82.

However, when each of the above described conventional sound generators falls and collides with a hard ground, the coil spring 59 or spring plate 62 disengages from the terminal. Furthermore, there must be provided a plurality of jigs for accurately soldering the coil spring or spring plate, which requires multiple manufacturing steps. In the case using the cord, it is necessary to provide expensive plug and socket.

SUMMARY OF THE INVENTION

An object of the present invention is to provide a speaker having an external connecting terminal structure which has a high reliability and may be simply manufactured without accuracy jigs, and at a low cost.

According to the present invention, there is provided a speaker having a frame provided with a yoke, a magnet, a vibrating plate and a voice coil, and a pair of leads, wherein an end of each of the leads is connected to an end of the voice coil and the other end portion of the lead is secured to the frame and the underside of the other end portion is exposed, a terminal connecting device is provided for connecting the lead to an outside terminal, the terminal connecting device comprises a cylindrical case secured to the frame, a connecting rod slidably mounted in the cylindrical case, a coil spring provided in the cylindrical case to outwardly urge the connecting rod so as to be contacted with the outside terminal at an end of the connecting rod, and means for contacting the cylindrical case with the other end portion of the lead.

In an aspect of the invention, the means is engagement of a projection of the cylindrical case with a hole formed in the other end of the lead so as to keep the contact of the cylindrical case with the end of the lead.

In another aspect of the invention, the means comprises a ball provided in the cylindrical case so as to be outwardly urged by the coil spring to be contacted with an inside wall of a hole formed in the end of the lead.

The end of the connecting rod has a spherical shape.

The cylindrical case is secured in a hole formed in the frame in force fit engagement.

These and other objects and features of the present invention will become more apparent from the following detailed description with reference to the accompanying drawings.

DETAILED DESCRIPTION OF THE PREFERRED EMBODIMENT

Figure 1:
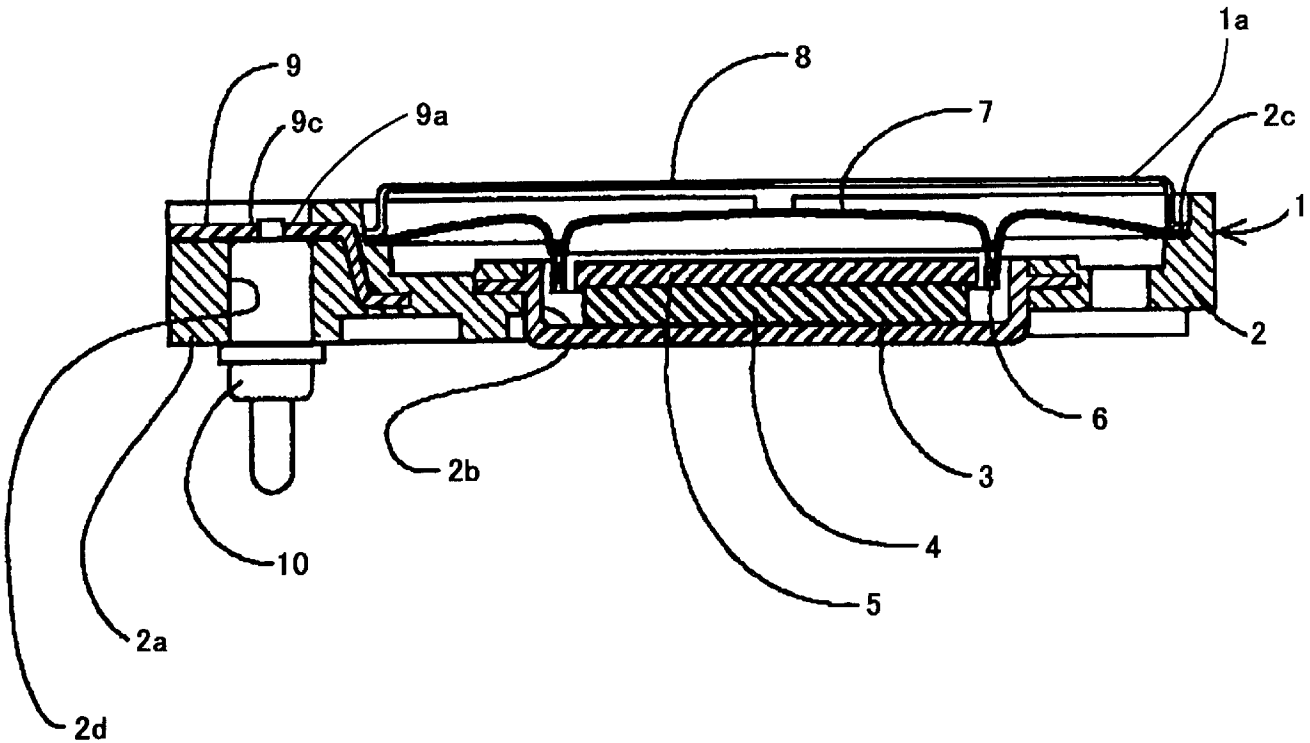
FIG. 1 is a sectional view of a speaker according to the present invention.
Figure 5:
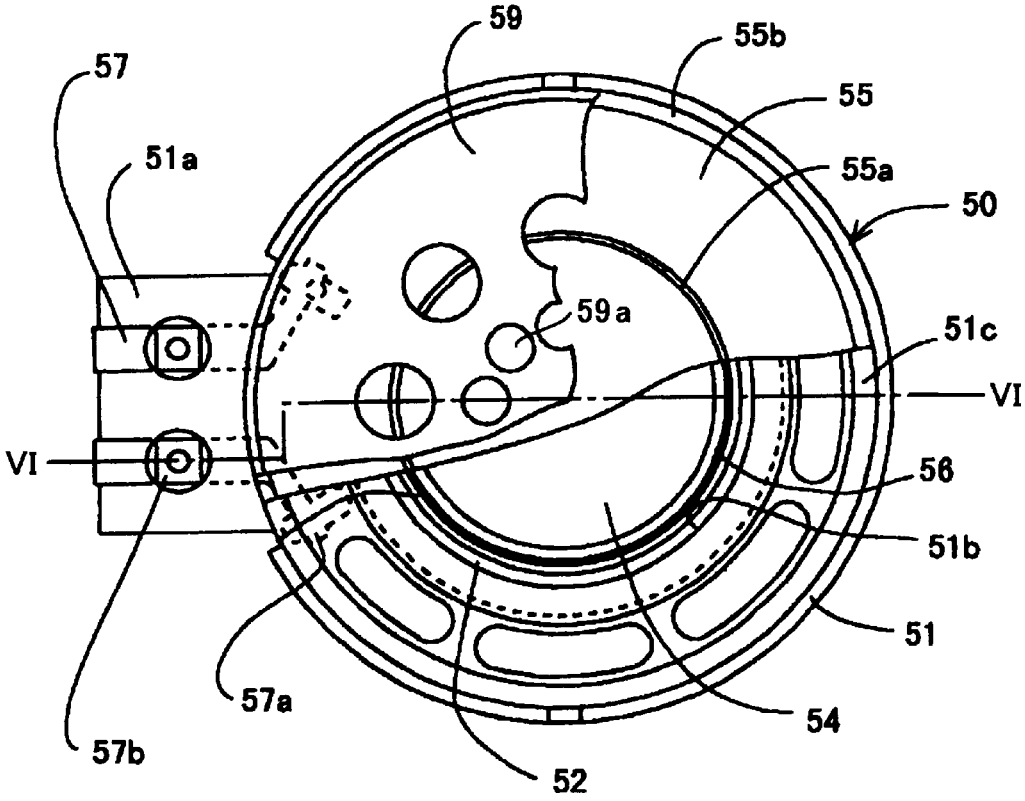
FIG. 5 is a plan view of a conventional speaker.
Figure 6:
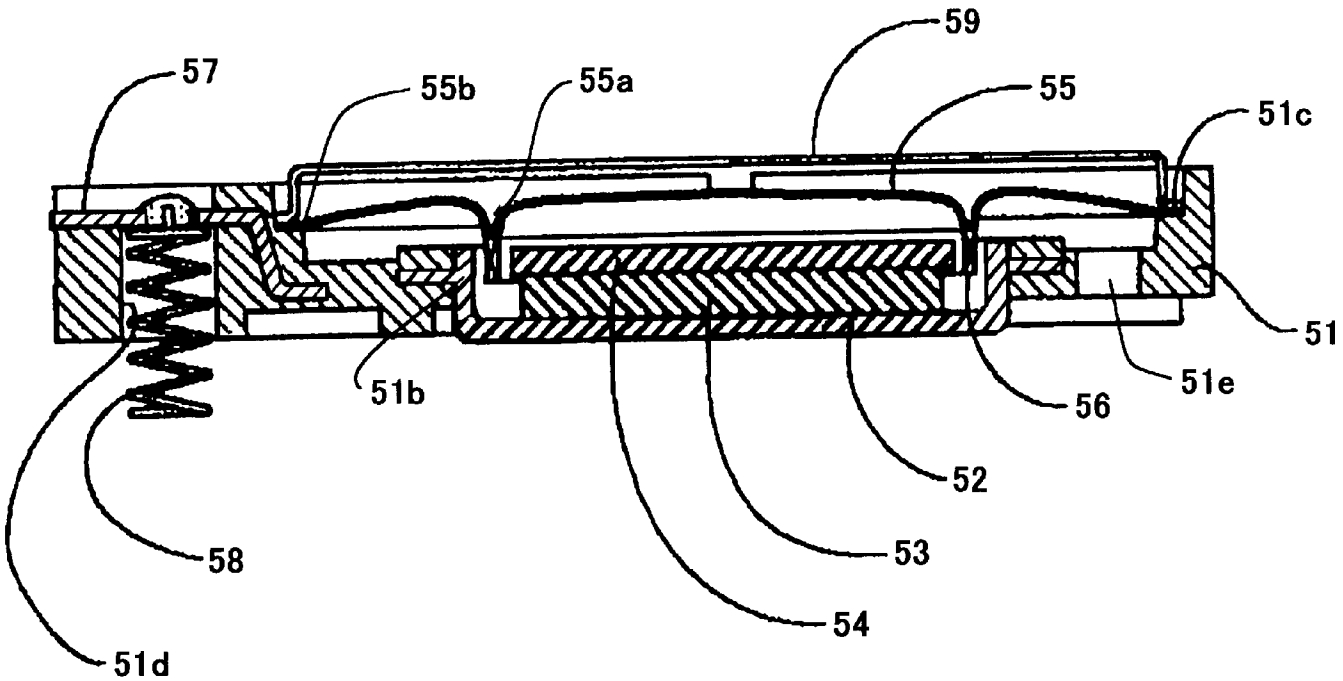
FIG. 6 is a sectional view of the conventional speaker taken along a line VI—VI of FIG. 5.
Figure 7A:
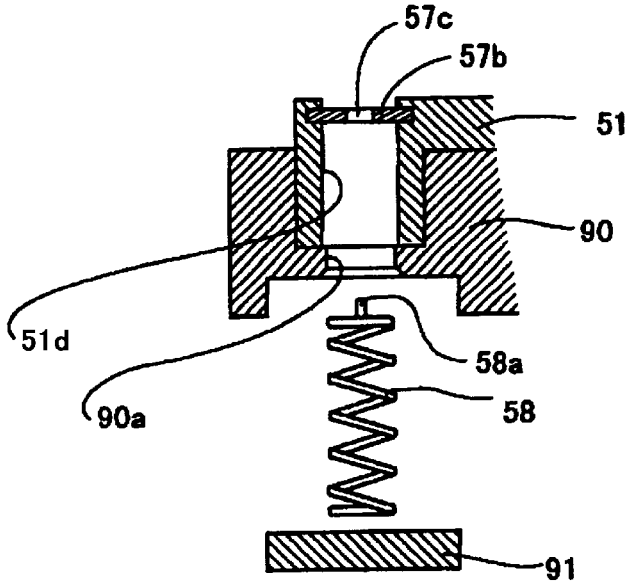
FIGS. 7*a* and 7*b* are sectional views showing a method for assembling the coil spring.
Figure 7B:
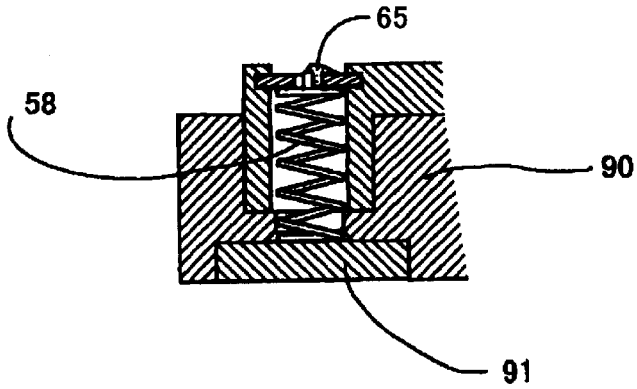
Figure 8:
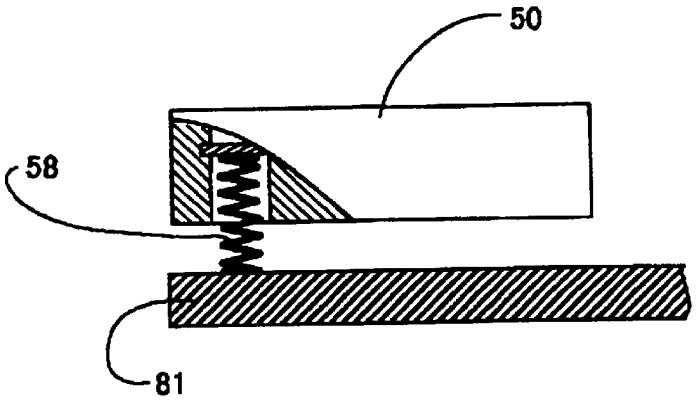
FIG. 8 shows the mounting condition of a portable telephone.
Figure 9:
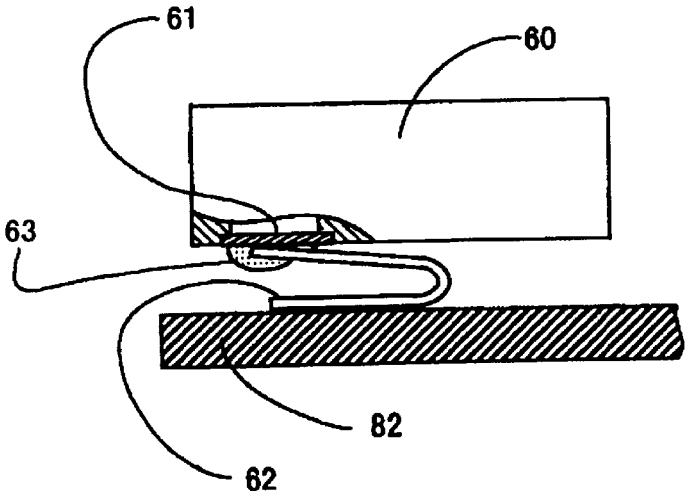
FIGS. 9 and 10 are sectional views of other conventional connecting devices, respectively.
Figure 10:
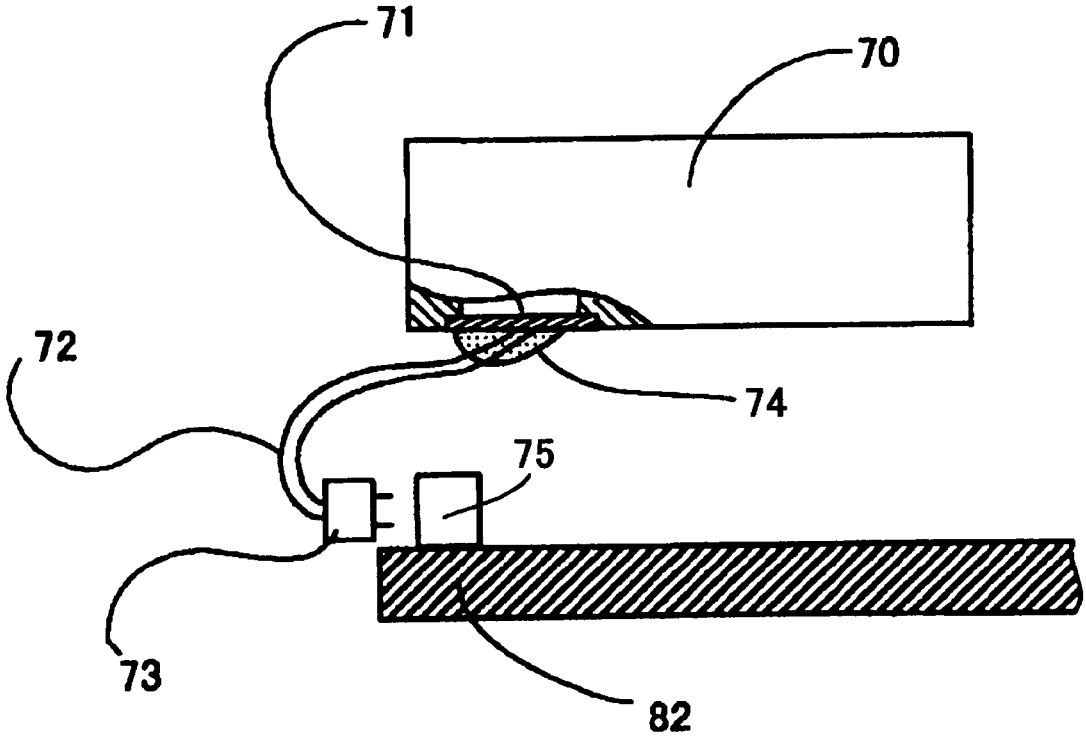

Referring to FIG. 1 showing a sectional view of a speaker of the present invention, the body of the speaker has the same construction as the conventional speaker shown in FIGS. 5 and 6. Namely, a speaker 1 has a frame 2.

A cubic portion 2*a*, a central circular hole 2*b* and a shoulder 2*c* are formed on the frame 2.

A yoke 3 made of magnetic material is embedded in the frame 2. A circular magnet 4 and a top plate 5 are mounted on the yoke 3. A circular vibrating plate 7 having a voice coil 6 is secured on the shoulder 2*c*. Thus, a magnetic circuit is formed by the yoke 3, magnet 4 and vibrating plate 7.

A pair of lead plates 9 are embedded in the frame 2.

Each of the lead plates 9 is extended between an end portion 9*a* exposed in a hole 2*d* and an end of the coil 6. The end portion 9*a* has a hole 9*c* at a central portion thereof.

In accordance with the present invention, a terminal connecting device 10 is provided to be inserted in the hole 2*d* of the frame 2.

Figure 2A:
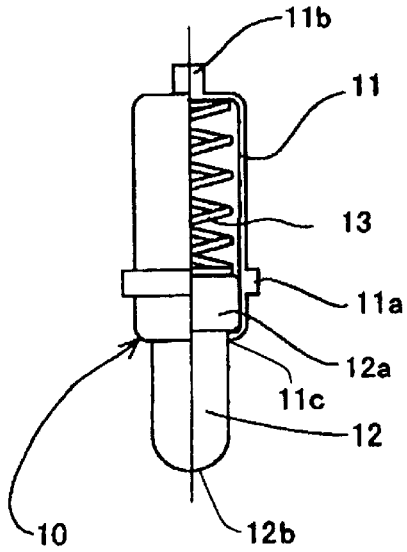
FIGS. 2*a* and 2*b* are sectional views of terminal connecting devices for external terminals.

Referring to FIG. 2*a*, the terminal connecting device 10 comprises a cylindrical case 11 and a connecting rod 12 which are made of metal. The connecting rod 12 has a spherical end 12*b* and a head 12*a* having a larger diameter than the rod 12 and is slidably engaged with the inside wall of the cylindrical case 11. An opening end of the cylindrical case 11 is narrowed to form a stopper edge 11*c*. A coil spring 13 is inserted in the cylindrical case 11, compressed between the closed top end and the head 12*a*. The connecting rod 12 is outwardly urged by the coil spring 13 and stopped by the engagement of the head 12*a* with the stopper edge 11*c*. A projection 11*b* is formed on the top end of the cylindrical case 11, and a flange 11*a* is formed at a lower portion of the case 11. Each component member 11, 12 and 13 is coated with gold plating.

Figure 3:
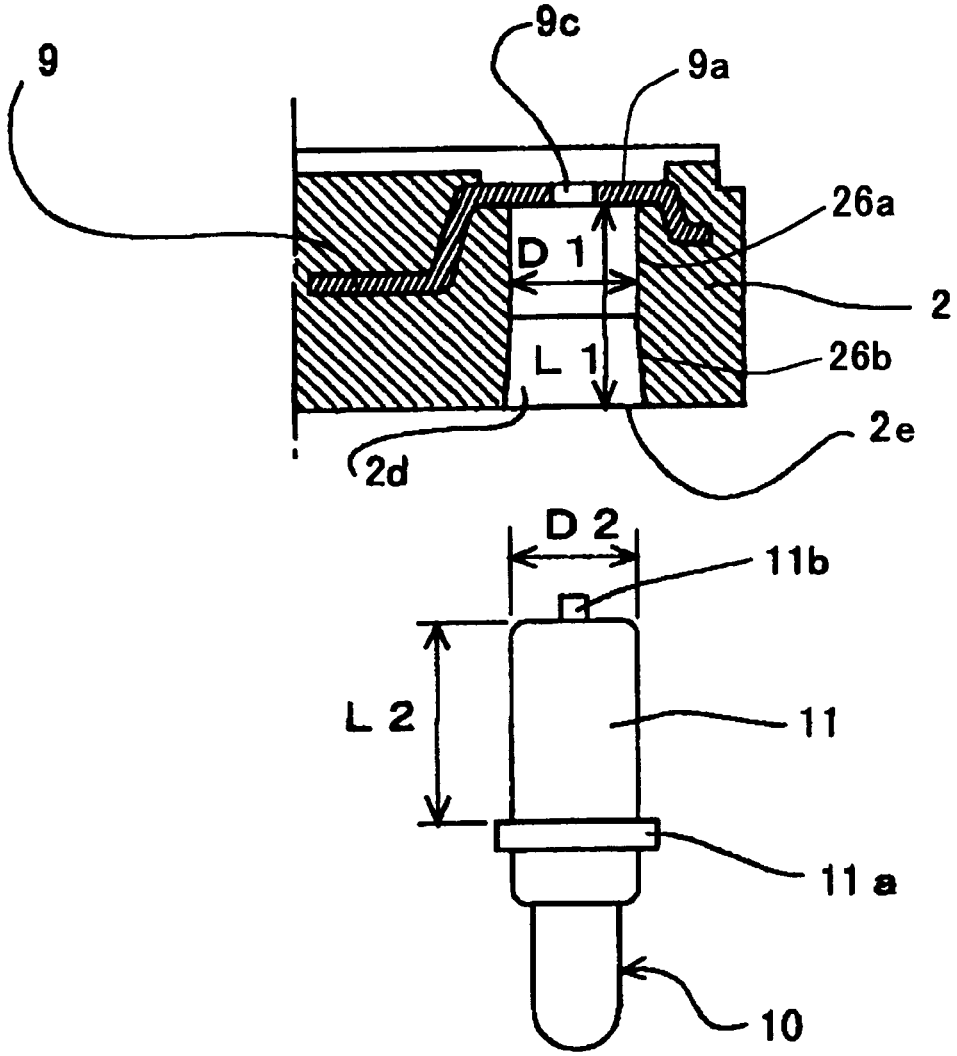
FIG. 3 is a sectional view for explaining the attaching of the terminal connecting device.

Referring to FIG. 3, the hole 2*d* comprises an inner hole 26*a* having a diameter D1 and a taper hole 26*b*. The diameter D1 is slightly smaller than the diameter D2 of the cylindrical case 11, and the diameter at the opening end of the taper hole 26*b* is slightly larger than the diameter D2. The length L1 of the hole 2*d* is slightly shorter than the length L2 of the cylindrical case 11 between the top end of the cylindrical case and the flange 11*a*.

In order to insert the terminal connecting device 10 in the hole 2*d*, first, the top end portion of the cylindrical case 11 is inserted in the opening end of the taper hole 26*b*. Next, a fork of a pressing jig pushes the flange 11*a* of the case until the flange pressed against a lower end face 2*e* of the frame 2. At the time, the projection 11*b* is inserted in the hole 9*c* of the end portion 9*a* of the lead plate 9. Since the diameter D1 is smaller than the diameter D2, the case 11 is securely engaged with the hole 2*d* in force fit. In addition, since the length L1 of the hole 2*d* is shorter than the length L2 of the cylindrical case 11, the top end surface of the case 11 is strongly pressed against the underside of the end portion 9*a*. Thus, the case 11 is securely connected to the lead plate 9.

Figure 2B:
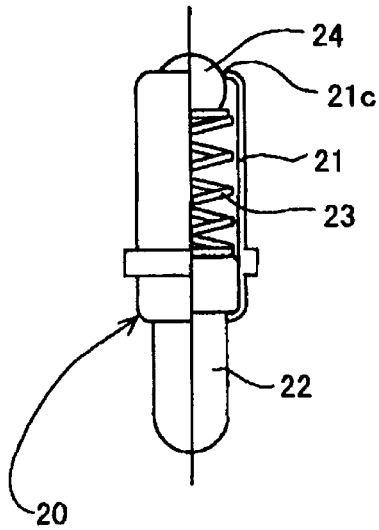

FIG. 2*b* shows another example of the terminal connecting device. The terminal connecting device 20 comprises a cylindrical case 21, connecting rod 22 and coil spring 23. The cylindrical case 21 further has a narrow opening end to form a stopper edge 21*c*. A ball 24 is provided in the case 21 and pressed against the stopper edge 21*c* by the coil spring 23.

When assembled in the hole 2*d*, the ball 24 is pressed against the peripheral edge of the hole 9*c* of the end portion 9*a* of the lead plate 9. Thus, the ball 24 and hence the terminal connecting device 20 is securely connected with the lead plate 9.

Figure 4A:
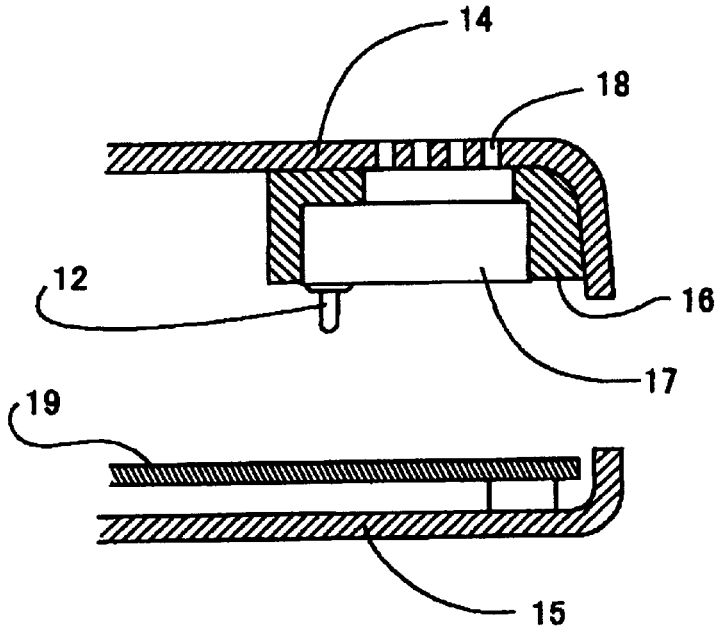
FIGS. 4*a* and 4*b* are sectional views showing the attaching of the speaker to a portable telephone.
Figure 4B:
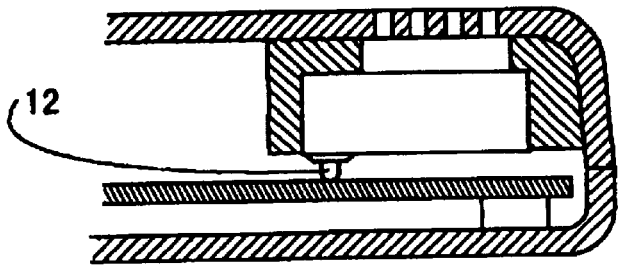

FIGS. 4*a* and 4*b* show assembling operation of the speaker to a portable telephone. The portable telephone has an upper case 14 and a lower case 15. The speaker 17 of the present invention is mounted in a gasket housing 16 provided in the upper case 14. A sound emanating hole 1*a* (FIG. 1) of the speaker 17 is communicated with sound emanating holes 18 of the upper case 14.

When the upper case 14 and the lower case 15 are combined with each other, the connecting rod 12 of the speaker 17 is resiliently pressed against a terminal of a printed circuit board 19 in the lower case 15, while the connecting rod 12 is forced in the cylindrical case 11, compressing the coil spring 13 (23) as shown in FIG. 4*b*. Thus, the spherical end 12*b* of the connecting rod 12 is strongly pressed against the terminal of the circuit board 19 at a large pressure (0.5 N–1.0 N), so that the speaker 17 of the present invention is securely mounted in the portable telephone.

In accordance with the present invention, the terminal connecting device of the speaker is pressed against the lead plate of the speaker so as to connect the speaker with the outside circuit board. Therefore, the terminal connecting device is connected to the speaker without soldering. Furthermore, since the connecting rod of the terminal connecting device is resiliently pressed against the terminal of the circuit board, the speaker and the electronic instrument are reliably connected with each other.

While the invention has been described in conjunction with preferred specific embodiment thereof, it will be understood that this description is intended to illustrate and not limit the scope of the invention, which is defined by the following claims.

What is claimed is:

1. A speaker comprising:

a cylindrical frame (2) provided with a yoke, a permanent magnet, a vibrating plate and a voice coil secured to the vibrating plate, the cylindrical frame having a pair of holes (2*d*) each of which is formed in an axial direction of the frame and opened to an underside of the frame, a pair of lead plates (9) embedded in the frame, an end of each of the lead plates being connected to an end of the voice coil, and the other end (9*a*) of the lead plate being exposed in the hole, a terminal connecting device (10) provided in each of the holes, wherein the terminal connecting device comprises a cylindrical case (11) made of metal and secured to an inside wall of the hole by a securing means, the cylindrical case has an upper closed end portion and a lower end opening, and a flange (11*a*) formed at a lower portion thereof, a connecting rod (12) made of metal and having a head (12*a*) slidably engaged with an inside wall of the cylindrical case, a coil spring (13) provided between the upper closed end and the head (12*a*) so that the connecting rod is projected from the lower end opening and stopped by engagement of head with a stopper edge (11*c*), the flange is pressed against an underside of the frame, thereby pressing the upper closed end portion of the cylindrical case against the underside of the other end (9*a*) of the lead plate.

2. The speaker according to claim 1, wherein the upper end portion is an upper end surface.

3. The speaker according to claim 1, wherein the upper end portion is a ball provided in an opening formed in an upper end wall.

4. The speaker according to claim 1, wherein the securing means is force fit engagement.

* * * * *